US011685488B2

(12) United States Patent
Buksowicz

(10) Patent No.: US 11,685,488 B2
(45) Date of Patent: Jun. 27, 2023

(54) BOAT LIFT AND METHOD

(71) Applicant: Jan Tadeusz Buksowicz, Vernon (CA)

(72) Inventor: Jan Tadeusz Buksowicz, Vernon (CA)

(73) Assignee: PARADISE DOCK & LIFT INC., Vernon (CA)

( * ) Notice: Subject to any disclaimer, the term of this patent is extended or adjusted under 35 U.S.C. 154(b) by 0 days.

(21) Appl. No.: 17/401,150

(22) Filed: Aug. 12, 2021

(65) Prior Publication Data

US 2022/0048603 A1 Feb. 17, 2022

Related U.S. Application Data

(60) Provisional application No. 63/065,429, filed on Aug. 13, 2020.

(51) Int. Cl.
*B63C 3/06* (2006.01)

(52) U.S. Cl.
CPC ..... *B63C 3/06* (2013.01)

(58) Field of Classification Search
USPC ..... 405/1, 3
See application file for complete search history.

(56) References Cited

U.S. PATENT DOCUMENTS

| | | | | |
|---|---|---|---|---|
| 5,890,835 | A * | 4/1999 | Basta | B63C 3/06 114/44 |
| 8,979,426 | B2 * | 3/2015 | Doig | B63C 3/06 114/44 |
| 10,059,412 | B1 * | 8/2018 | Basta | B66F 7/0641 |
| 2014/0017009 | A1 * | 1/2014 | Hey | B63C 3/06 405/3 |

* cited by examiner

*Primary Examiner* — Sean D Andrish
(74) *Attorney, Agent, or Firm* — Richard D. Okimaw

(57) ABSTRACT

An apparatus and method for lifting a boat. The apparatus comprises a base frame, a lifting platform engagable upon the bottom surface of a boat, at least one lifting arm rotatably connected to each of the base frame and the lifting platform, wherein the at least one lifting arm is substantially horizontal at a lowered position and substantially vertical at a raised position and at least one linear actuator extending between the frame and a top surface of the at least one lifting arm so as to be extended at the lowered position and retracted at the raised position. The method comprises positioning the boat above the lifting platform in its lowered position and pulling on a top surface of the lifting arm with at least one linear actuator so as to rotate the at least one lifting arm from a substantially horizontal position to a substantially vertical position.

15 Claims, 6 Drawing Sheets

BOAT LIFT AND METHOD

CROSS REFERENCE TO RELATED APPLICATION

This application claims benefit of U.S. provisional patent application No. 63/065,429 filed on Aug. 13, 2020 entitled Boat Lift.

BACKGROUND

1. Technical Field

This disclosure relates generally to lifting devices in general and in particular to a method and apparatus for lifting a boat to a stored position above a body of water.

2. Description of Related Art

Boating is a common and popular recreational activity. Many boat owners choose to leave their boat in the water in between boating trips to avoid having to launch the boat each time it is desired to be used. In particular, for owners having a dock or other water's edge access, it may be desirable to have their boat tied or otherwise secured to a dock or buoy to keep the boat in the desired location.

One difficulty with tying up the boat to another object in between uses is that the boat may be prone to getting dirty or fouled by the water in which it sits. Furthermore, boats tied up in the water may be more prone to damage or sinking due to storms or waves. One common alternative is therefore to store the boat on a lift above water in between uses. In particular one type of boat lift is to provide one or more lifting surfaces which are rotated by lever arms supported on a base 12. An example of such a boat lift is illustrated in FIG. 1 at 10. Disadvantageously, such boat lifts utilize a hydraulic cylinder 18 to lift a pair of bunks 14 on which the boat rests, which is supported by lifting arms 16. The hydraulic cylinders are extended at a lower position of the bunks and retracted in the raised position. It will be appreciated that boat lifts spend the majority of their time in the water and therefore the rod and cylinder will be exposed to the water for the greater portion of this time. Such exposure allows debris and other material to accumulate on the rod fouling it or resulting in corrosion from exposure to salt water environments.

Additionally, the cylinder of such designs is commonly located to the side of the lifting arms requiring a cantilever connection between the lifting arm and the hydraulic cylinder to one side. It will be appreciated that such cantilever design increases loads on such connection and therefore may render such designs prone to failure or increased maintenance.

SUMMARY OF THE DISCLOSURE

According to a first embodiment, there is disclosed an apparatus for lifting a boat comprising base frame, a lifting platform engagable upon the bottom surface of a boat, at least one lifting arm rotatably connected to each of the base frame and the lifting platform, wherein the at least one lifting arm is substantially horizontal at a lowered position and substantially vertical at a raised position and at least one linear actuator extending between the frame and a top surface of the at least one lifting arm so as to be extended at the lowered position and retracted at the raised position.

The at least one linear actuator may be selected from the group consisting of pneumatic and hydraulic cylinders. The raised vertical position may be angled past vertical towards the at least one actuator.

The at least one linear actuator may extend to a pivot on the at least one lifting arm. The at least one lifting arm may include a bracket extending away therefrom in a direction towards the at least one linear actuator wherein the bracket includes the pivot. The pivot may be spaced apart from the lifting arm by a pivot gap. The pivot gap may be selected to be between 1 and 7 inches. The base frame may include a base bracket extending upwardly therefrom, the base bracket supporting and spacing an end of the at least one linear actuator away from the base frame by a base distance. The base distance may be selected to be between 5 and 15 inches.

The lifting platform may comprise at least a pair of parallel spaced apart bunks. Each bunk may be supported by at least two lifting arms. The at least two lifting arms may have a substantially equal length so as to maintain the bunks in the same angular orientation between the lowered and raised positions. The lifting arms of adjacent bunks may be connected by a cross brace. The cross brace may have an adjustable length so as to enable the spacing between the bunks to be adjusted. The base frame may have an adjustable width.

According to a further embodiment, there is disclosed a method for lifting a boat comprising positioning the boat above a lifting platform in its lowered position wherein the lifting platform is connected to a base frame with at least one lifting arm, and pulling on a top surface of the at least one lifting arm so as to rotate the at least one lifting arm from a substantially horizontal position to a substantially vertical position with at least one linear actuator extending between a top surface of the at least one lifting arm and the base frame.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
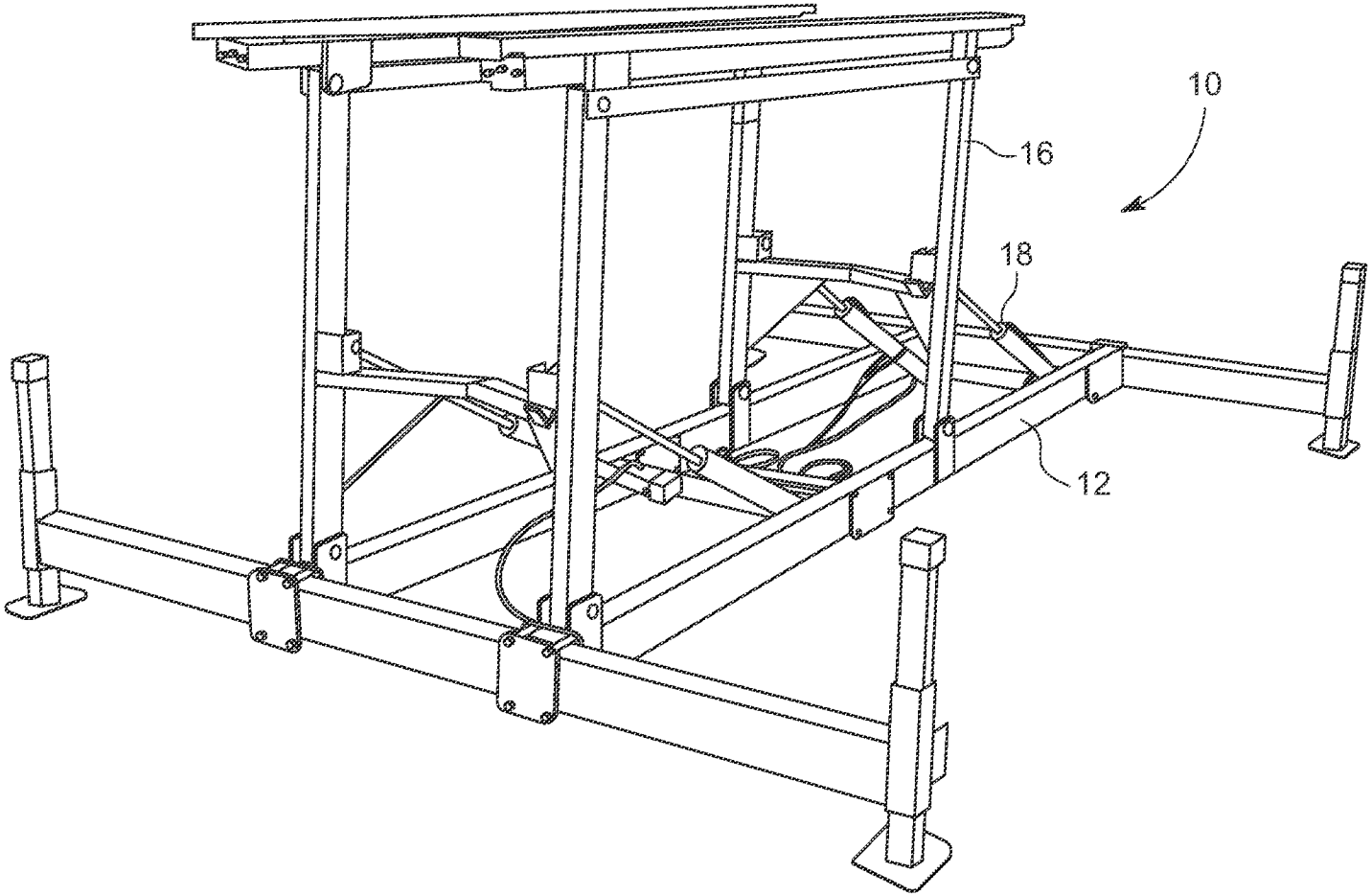
FIG. 1 (PRIOR ART)
FIG. 1 is a perspective view of a prior art boat lift at a position.
Figure 2:
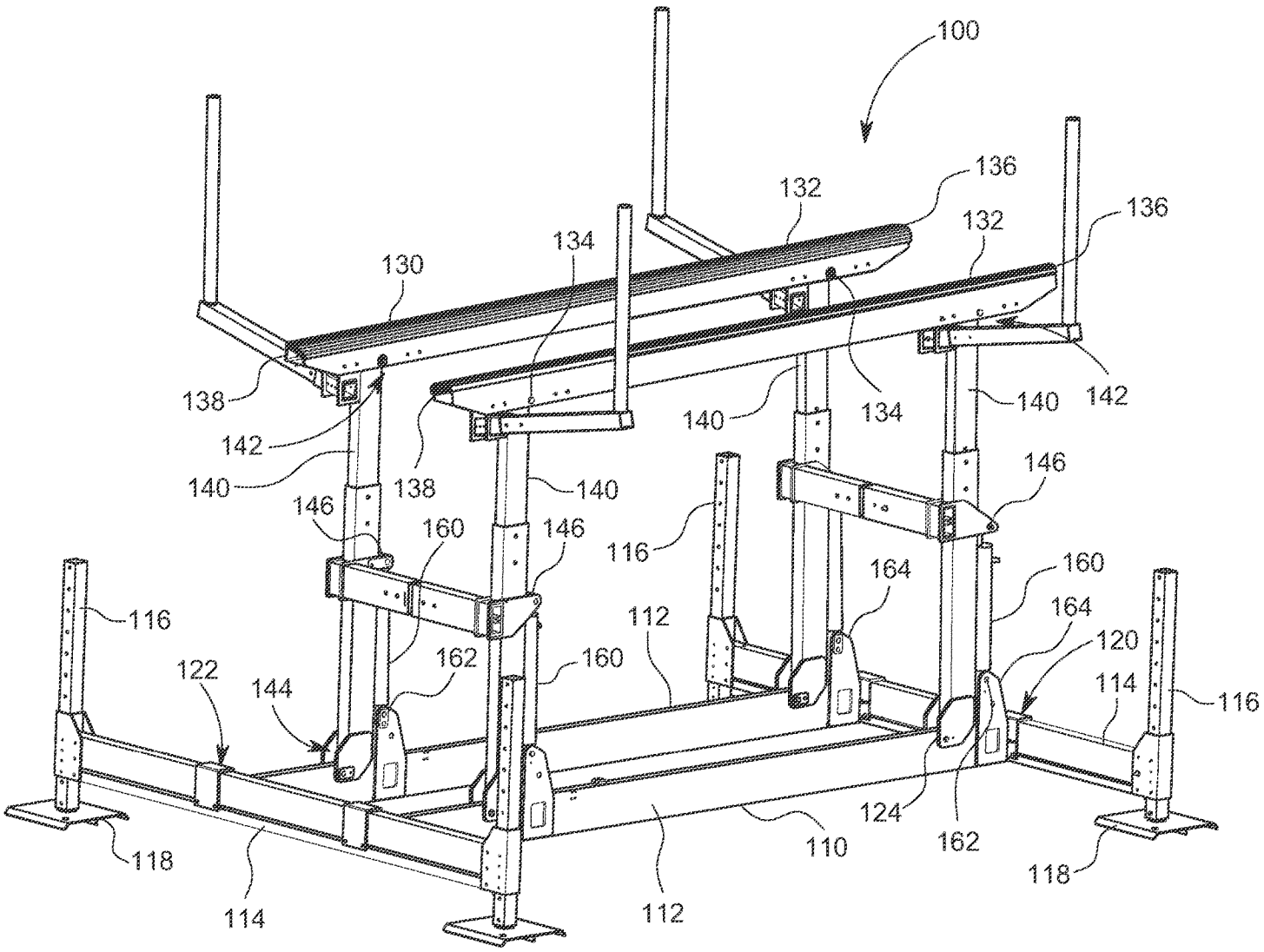
FIG. 2 is a perspective view of a boat lift according to an exemplary embodiment at a raised position.
Figure 3:
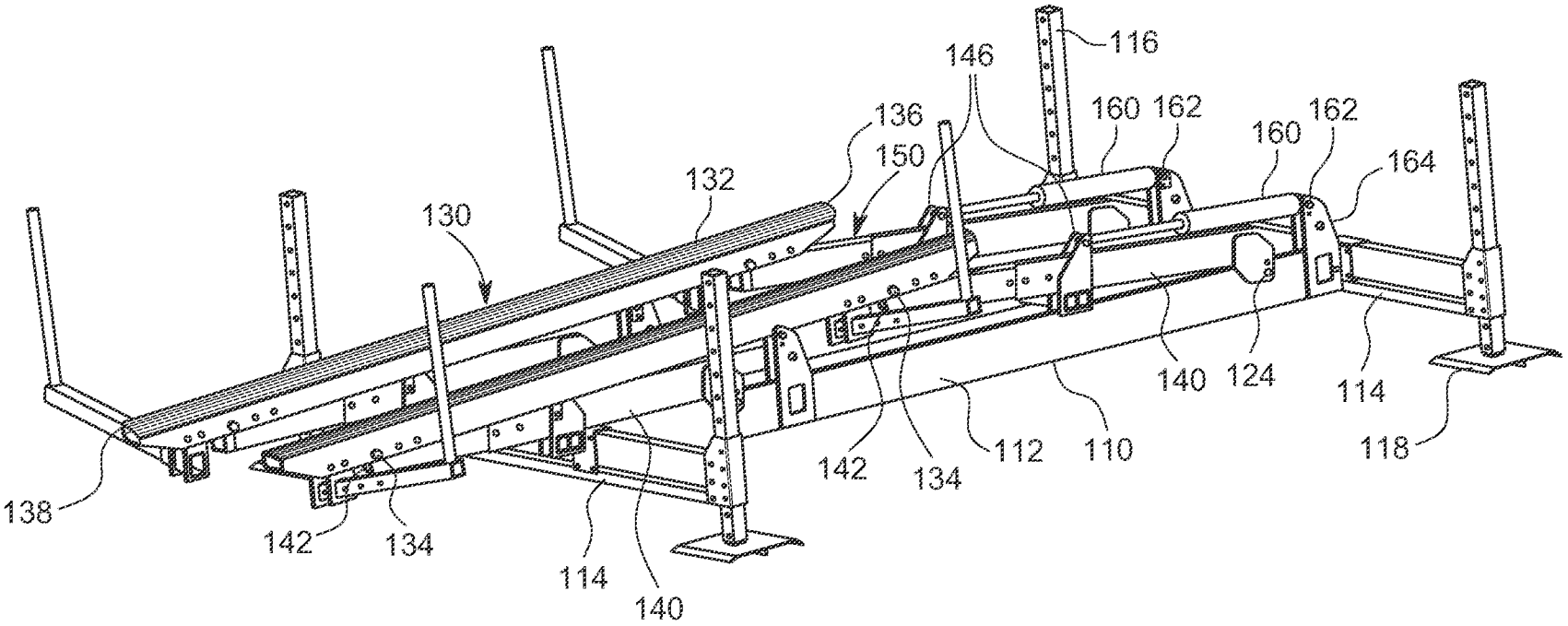
FIG. 3 is a perspective view of the boat lift of FIG. 2 at a lowered position.
Figure 5:
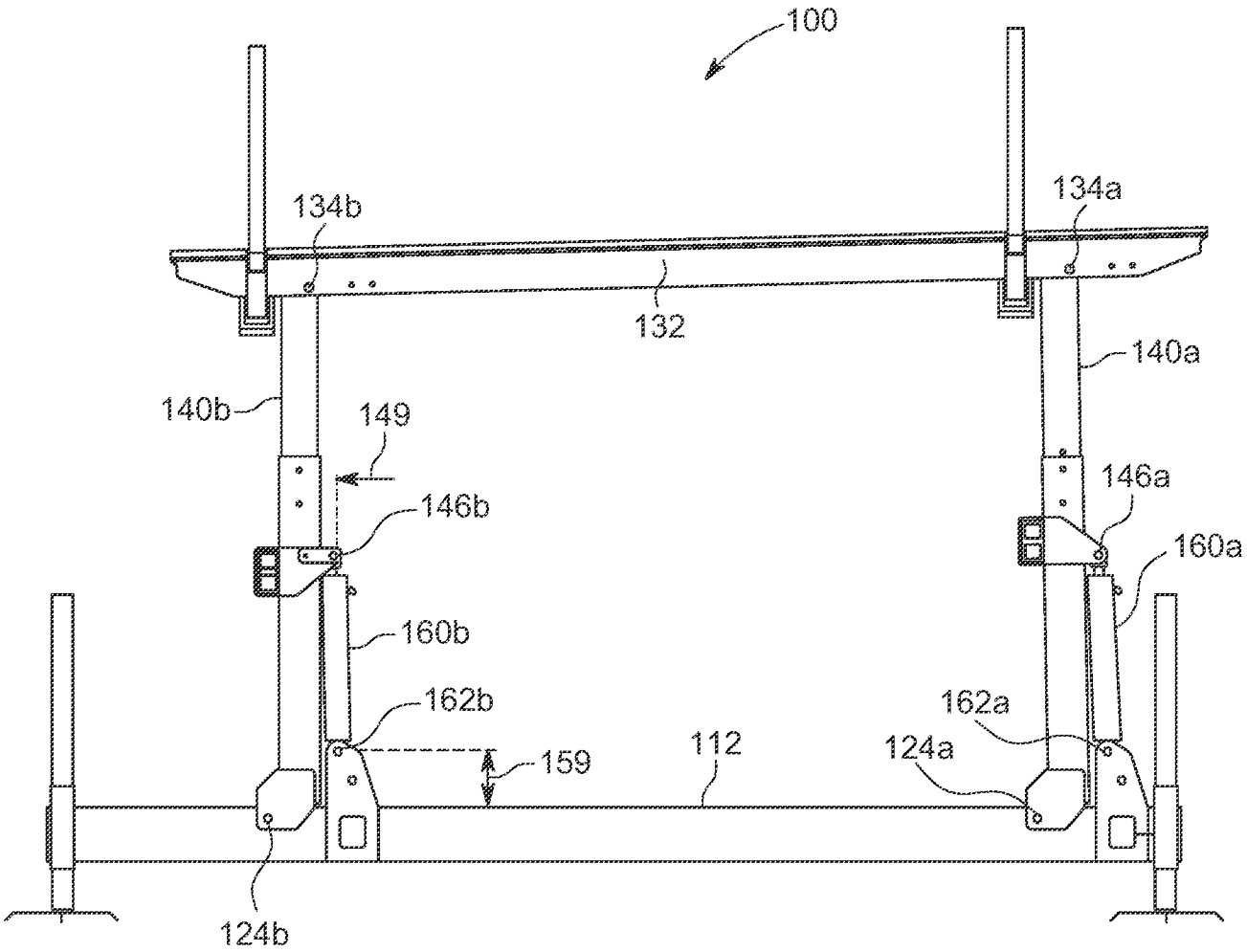
FIG. 5 is a side view of the boat lift of FIG. 3 at a raised position.

Aspects of the present disclosure are now described with reference to exemplary apparatuses, methods and systems. Referring to FIG. 2, an exemplary apparatus for lifting a boat according to a first embodiment is shown generally at 100. The boat lift 100 comprises a base frame 110 rotatably supporting at least one lifting arm 140 to lift a boat platform 130 to a raised positon as illustrated in FIG. 2. The lifting arms 140 are rotated from a substantially horizontal position as illustrated in FIG. 3 to a substantially vertical position as illustrated in FIGS. 2 and 5 by a hydraulic cylinder 160 operable to retract to lift the lifting arms 140. As illustrated adjacent lifting arms 140 may be connected by a cross member 148 so as to ensure that the adjacent bunks are raised and lowered at the same time.

As illustrated in FIG. 2, according to one exemplary embodiment, the base frame 110 may be formed of a pair of parallel spaced apart frame rails 112 with one or more cross bars 114. It will be appreciated that other arrangements and configurations of the base frame 110 as are known may also be utilized. The base frame 110 extends between front and rear ends, 120 and 122, respectively. The base frame 110 may be supported or positioned in the water at the desired location by a plurality of legs 116 extending therefrom. As illustrated in FIGS. 2 and 3, the legs 116 may be adjustable through known means and have ground engaging feet 118 at a bottom end thereof. It will be appreciated that while the present base frame 110 is illustrated and described above as supported on feet, that the base frame may also be supported at a desired position in the water by any other means including, without limitation, secured to a pier, dock or floating structure or through any other means as are known.

The lifting platform 130 comprises one or more boat supporting bunks 132 adapted to engage the bottom surface of a boat. It will be appreciated that any configuration, material and construction of bunks 132 may be utilized as are commonly known for supporting a flat bottom, v-bottom, catamaran or pontoon boat by way of non-limiting example or including cushioning as is known. As illustrated in FIGS. 2 and 3, the pair of bunks 132 may include an angled top surface as is commonly utilized for supporting a v-bottom boat therebetween. It will also be appreciated that more than one pair of bunks may be utilized for supporting each side of a pontoon boat or a catamaran or may optionally include separate pairs of bunks for the front and rear of the boat. The bunks 132 extend between front and rear ends, 136 and 138, respectively corresponding to the front and rear ends of the boat.

The lifting arms 140 extend between top and bottom ends 142 and 144, respectively, and are pivotally connected to the base frame 110 at base pivot 124 and pivotally connected to the lifting platform 130 at platform pivot 134. With reference to FIGS. 2 and 3, the lifting arms are rotatable about the base pivots 124 so as to translate the lifting platform from the raised position illustrated in FIG. 2 to the lowered position illustrated in FIG. 3. It will be appreciated that the lowered position will be selected to be a sufficient depth below the water to allow the boat to be moved on and off the lifting platform whereas the raised position will lift the boat substantially out of the water. As illustrated in FIGS. 2 and 3, the lifting arms 140 are pivotal and in alignment with the frame rails 112 although it will be appreciated that other configurations may be useful as well.

Figure 4:
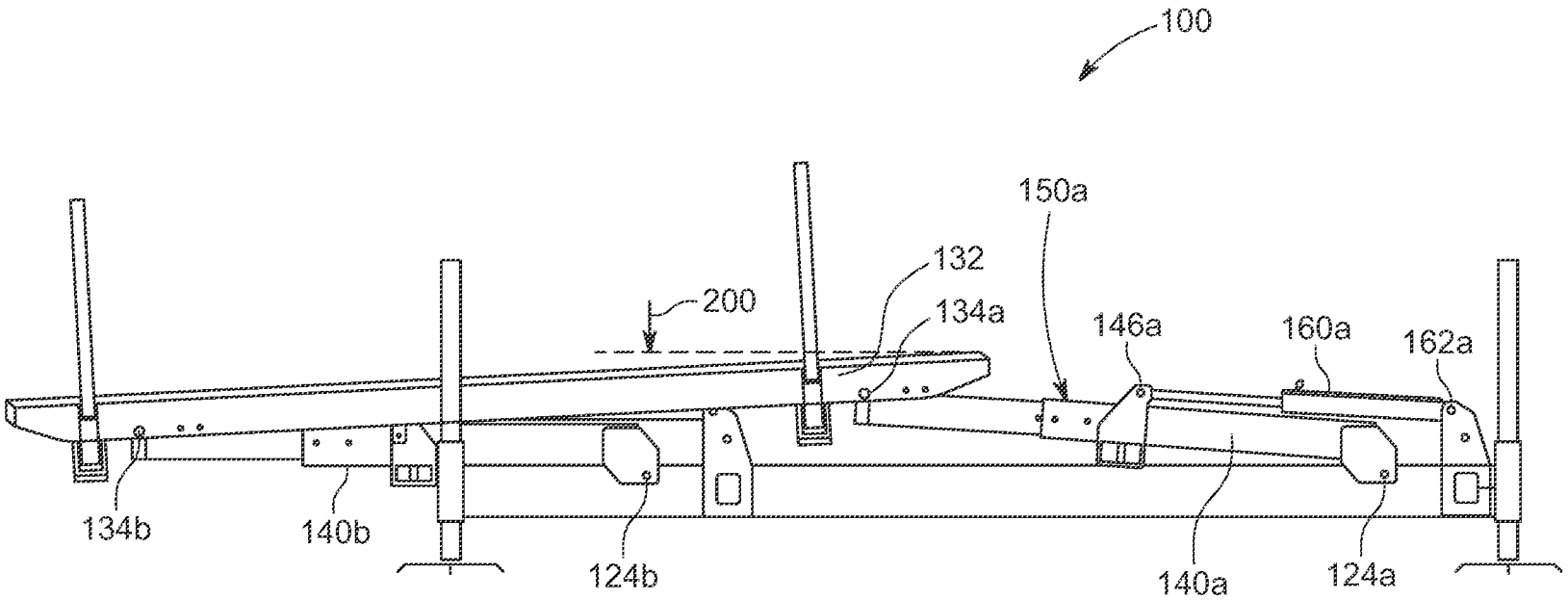
FIG. 4 is a side view of the boat lift of FIG. 3 at a lowered position.

Turning now to FIGS. 4 and 5, the boat lift at the lowered and raised positions are illustrated. In FIGS. 4 and 5, the front lifting arms are designated 140*a* whereas the rear lifting arms are designated 140*b*. In particular, it will be observed that at the lowered position, in FIG. 4, the bunks 132 are angled to the rear by a loading angle 200 so as to assist with a boat being positioned thereon whereas the bunks 132 are substantially horizontal at the raised position illustrated in FIG. 5. The difference in angular orientation of the bunks between the lowered and raised positons may be achieved by positioning the frame pivots 134*a* and 134*b* further apart than the platform pivots 124*a* and 124*b*. Furthermore, it will be appreciated that the frame pivots 134*a* and 134*b* may be spaced apart by the same distance as the platform pivots 124*a* and 124*b* so as to maintain a horizontal orientation of the bunks 132 if so desired by a user. Further differences between the movement and orientations of the bunks may be utilized as are commonly known.

The linear actuators 160 may be selected to be any extending actuators as are commonly known. In practice it has been found that hydraulic or pneumatic cylinders have been useful for this purpose. Although the actuator are illustrated with the cylinders connected to the base frame 110 and the pistons connected to the lifting arms in the exemplary embodiment of FIGS. 2-5, it will be appreciated that the opposite orientation may also be useful. As set out above, the actuators 160 are pivotally connected to the base frame 110 at a bottom pivot 162 and pivotally connected to the lifting arm at a lifting pivot 146. The lifting pivot 146 may be located at any midpoint along the lifting arm 140 and are proximate to or above a top surface 150 of the lifting arms 140 in the horizontal configuration shown in FIG. 3. The bottom pivot 162 is located to the side of lifting arm 140 adjacent to the top surface 150 when in the lifting arm 140 is in the vertical configuration illustrated in FIG. 2. As illustrated, the bottom pivot 162 is also set at a position above the base pivot 124 so as to permit the actuator 160 to provide a sufficient force to be able to pull the lifting arm 140 from the lowered to the raised position. The base frame 110 may include a raised base bracket 164 for positioning the bottom pivot 162 above the base frame 110. It will be appreciated that the lifting arms are rotated over-centre in the upright position shown in FIGS. 2 and 5 such that the lift is maintained in the upright position without any force on the actuator as is commonly known.

Figure 6:
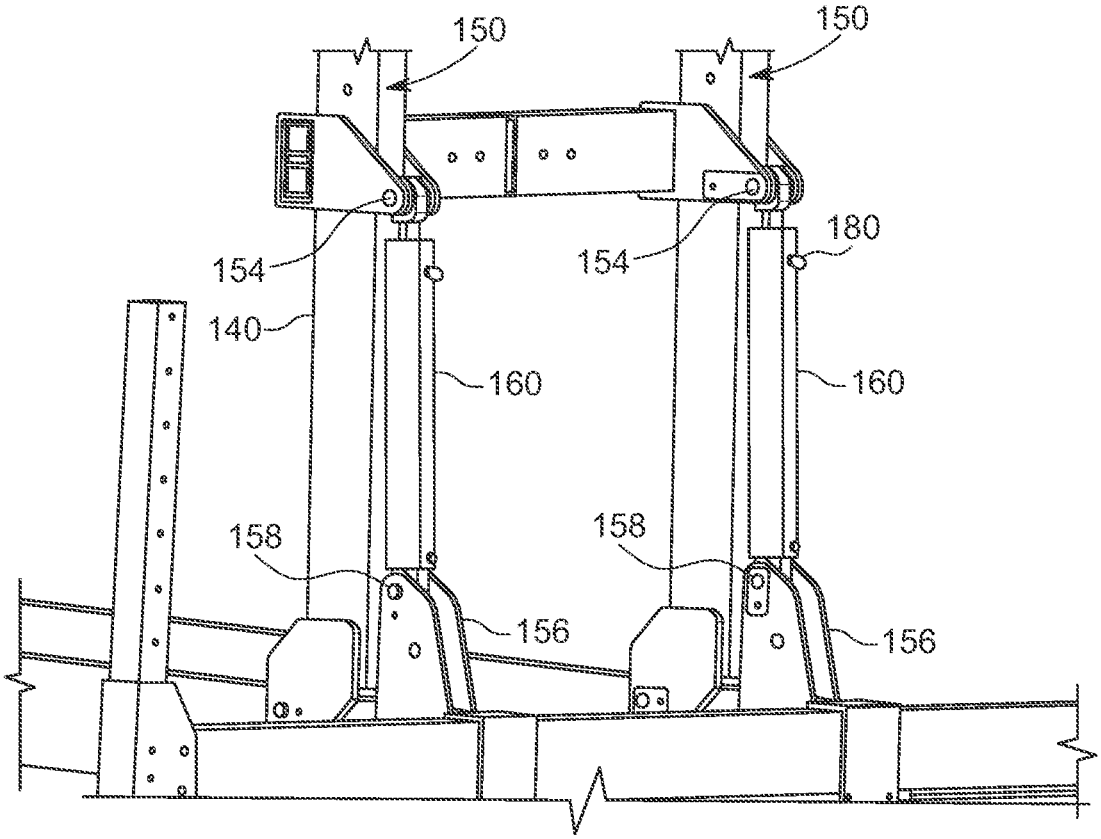
FIG. 6 is a detailed perspective view of one of the cylinders of the boat lift of FIG. 3.

Turning now to FIG. 6, a detailed view of the actuator and lifting arms is illustrated. In particular, the lifting arm may include first and second plates 152 extending therefrom so as to receive and end of the actuator 160 therebetween. The plates 152 may be located along the lifting arm which positions the pivot away from the lifting arm by a gap distance generally indicated at 149. The gap distance 149 may be selected to prevent the actuator 160 from impacting the lifting arm during the full range of motion thereof. In particular, the gap distance 149 may be selected to be between 1 and 7 inches (25 and 178 mm) although other distances may also be utilized. A pin 154 or other rotatable connection is then passed through the actuator end and the plates to pivotally secure them together. Similarly, the base frame 110 may include bracket plates 156 forming a base bracket extending therefrom which are secured to a bottom end of the actuator by a pin 158 or the like. The plates 156 support the pin 158 away from the base frame by a base gap distance generally indicated at 159. The gap distance 159 may be selected to prevent the actuator 160 from impacting the lifting arm during the full range of motion thereof. In particular, the gap distance 159 may be selected to be between 5 and 15 inches (127 and 381 mm) although other distances may also be utilized. Hydraulic or pneumatic lines 180, as are commonly known may extend from the actuator to permit operation thereof. In operation, the location of the actuators 160 on above the lifting arms will serve to contain the rods within the cylinders in the upright position such that the rods of the cylinders are protected from fouling and damage by the water. Such protection will in turn provide greater life and reliability of the present apparatus. Additionally, as the actuators are located above the lifting arms as opposed to extending below in many conventional designs, the present boat lift may be located in shallower water than conventional lifts as there is less concern of the actuators coming into contact with the floor of the body of water thereby damaging or fouling the actuator.

Although the lifting arms 140 and base frame 110 are illustrated as rectangular cross section members in the attached figures, it will be appreciated that other cross section profiles may also be utilized. In particular, one or more of the lifting arms or frame members may comprise C-channel or have a u-shaped cross section to permit the ends of the actuator to be located therein. Although the lifting arms 140 and frame rails 112 are described and illustrated as being spaced apart by cross bars and the like, it will be appreciated that the length of such cross bars may be variable. In particular, the cross bars may be replaceable so as to permit the bunks 132 to be spaced apart by any desired distance. The cross bars may also be telescoped or secured into sleeves in the lifting arms 140 and frame rails 112 so as to permit adjustment of the width of the present lift.

While specific embodiments have been described and illustrated, such embodiments should be considered illustrative only and not as limiting the disclosure as construed in accordance with the accompanying claims.

What is claimed is:

1. An apparatus for lifting a boat comprising:

a base frame;

lifting platform engagable upon a bottom surface of the boat;

at least one lifting arm rotatably connected to each of the base frame and the lifting platform, wherein the at least one lifting arm is substantially horizontal at a lowered position and upright at a raised position; and at least one linear actuator extending between the base frame at a position proximate to the at least one lifting arm and a top surface of the at least one lifting arm so as to be extended at the lowered position and retracted at the raised position; and a base bracket extending upwardly from the base frame, the base bracket supporting and spacing an adjacent end of the at least one linear actuator above the base frame by a base distance, wherein the at least one lifting arm is rotated away from the at least one linear actuator when moving from the raised position to the lowered position.

2. The apparatus of claim 1 wherein the at least one linear actuator is selected from the group consisting of pneumatic and hydraulic cylinders.

3. The apparatus of claim 1 wherein the raised position is angled past vertical towards the at least one actuator.

4. The apparatus of claim 1 wherein the at least one linear actuator extends to a pivot on the at least one lifting arm.

5. The apparatus of claim 4 wherein each of the at least one lifting arm includes a bracket extending away therefrom in a direction towards the at least one linear actuator wherein the bracket includes the pivot.

6. The apparatus of claim 5 wherein the pivot is spaced apart from the at least one lifting arm by a pivot gap.

7. The apparatus of claim 6 wherein the pivot gap is selected to be between 1 and 7 inches.

8. The apparatus of claim 1 wherein the base distance is selected to be between 5 and 15 inches.

9. The apparatus of claim 1 wherein the lifting platform comprises at least a pair of parallel spaced apart bunks.

10. The apparatus of claim 9 wherein the each bunk is supported by at least two of the at least one lifting arms.

11. The apparatus of claim 10 wherein the at least two lifting arms have a substantially equal length.

12. The apparatus of claim 9 wherein one of the at least one lifting arms of adjacent bunks are connected by a cross brace.

13. The apparatus of claim 12 wherein the cross brace has an adjustable length so as to enable a spacing between the bunks to be adjusted.

14. The apparatus of claim 1 wherein the base frame has an adjustable width.

15. A method for lifting a boat comprising:

positioning the boat above a lifting platform in a lowered position of the lifting platform wherein the lifting platform is connected to a base frame with at least one lifting arm, and pulling on a top surface of the at least one lifting arm with at least one linear actuator so as to rotate the at least one lifting arm from a substantially horizontal position away from the at least one linear actuator to an upright position with the at least one linear actuator extending between the top surface of the at least one lifting arm and a base bracket extending upwardly from the base frame at a position adjacent to the at least one lifting arm, the base bracket supporting and spacing an adjacent end of the at least one linear actuator above the base frame by a base distance.

* * * * *